US005279198A

United States Patent [19]

Cross

[11] Patent Number: 5,279,198

[45] Date of Patent: Jan. 18, 1994

[54] ADJUSTABLE MITER BOX WITH OFFSET CUTTING LOCATION

[76] Inventor: Raymond E. Cross, 910 N. Green Bay Rd., Lake Forest, Ill. 60045

[21] Appl. No.: 985,844

[22] Filed: Dec. 3, 1992

[51] Int. Cl.[5] ..... B27B 21/00

[52] U.S. Cl. ..... 83/758; 83/763; 83/767

[58] Field of Search ..... 83/758, 762, 763, 764, 83/767, 468, 468.3

[56] References Cited

U.S. PATENT DOCUMENTS

| | | | |
|---|---|---|---|
| 391,093 | 10/1888 | Sloat | 83/767 |
| 604,291 | 5/1898 | Bailey | 83/767 |
| 727,820 | 5/1903 | May | 83/767 |
| 851,023 | 4/1907 | McCartney | 83/758 |
| 1,035,466 | 8/1912 | Prentice | 83/763 |
| 1,048,447 | 12/1912 | Deitrick | 83/767 |
| 1,843,267 | 2/1932 | Burdick | 83/763 |
| 2,644,493 | 7/1953 | Hempe | 83/763 |
| 4,241,634 | 12/1980 | Ambler | 83/763 |

*Primary Examiner*—Hien H. Phan

*Attorney, Agent, or Firm*—Welsh & Katz, Ltd.

[57] ABSTRACT

An adjustable miter box for use with a miter saw having a blade includes a base having a top, a front face, a rear face, a first side and a second side, a generally vertically oriented pivot post located adjacent the rear face and being disposed in an offset location closer to the first side than to the second side, a saw guide including a vertical throughbore for matingly engaging the pivot post and defining a slot for slidingly and clampingly accommodating the blade of the miter saw, angular locking devices on the base for releasably fixing the angular position of the saw guide relative to the base, and workpiece support apparatus secured to the base for supporting and securing a workpiece to be cut by the saw while the saw is slidably engaged in the slot.

17 Claims, 2 Drawing Sheets

ADJUSTABLE MITER BOX WITH OFFSET CUTTING LOCATION

BACKGROUND OF THE INVENTION

The present invention relates to miter boxes for use with hand saws, and specifically to a miter box which is angularly adjustable relative to a vertical pivot axis located offset on the miter box base.

Conventional miter boxes designed for use with hand saws are either nonadjustable or angularly adjustable. The nonadjustable type is most commonly made of wood or plastic and includes a trough-like body with several angled, open-topped slots cut in the walls of the trough. These slots are used for guiding the blade of a saw for making miter cuts in pieces of wood placed on the bottom of the trough. A significant disadvantage of conventional miter boxes is that the available angles of cuts to be made in the workpiece are limited by the number and position of the slots.

Another disadvantage of conventional miter boxes relates to the structure of the miter saw blade itself. In order to prevent binding of the saw, the cross-section of the blade is slightly thinner in the body of the blade than at the cutting edge. Since the slots of the miter box must be wide enough to slidingly accommodate the cutting edge, there is significant play between the body of the blade and the edges of the slot. This play often allows the saw blade to move uncontrollably in the slot and interferes with the accuracy of the cuts. In addition, the width of the slots increases through use, to the extent that the slots eventually become too wide to ensure accurate cuts, and require the disposal of the miter box.

In response to these disadvantages, the adjustable miter box was developed. Adjustable miter boxes include an elongate metallic base with a generally centrally located pivotable saw guide, and a vertically projecting miter back extending laterally from either side of the saw guide. The saw guide is pivotable about a vertical pivot axis and includes both vertical and angular adjustments. A conventional backsaw is inserted into a vertical slot in the saw guide for reciprocal horizontal sliding action. A clamping device in the saw guide engages the saw body near the cutting edge to minimize lateral play while cutting.

In one commonly available adjustable miter saw, the angular adjustment includes a generally horizontally extending semicircular flange having a plurality of notches in its peripheral edge. To lock the angular position of the semicircular flange, an elongate, vertically extending fixed edge is provided which is coplanar with the workpiece guide and is positioned to engage the notches in the semicircular flange.

Although the adjustable miter box has greater durability and allows less saw play than the nonadjustable miter box, it has significant disadvantages of its own. One such disadvantage is the lack of adequate workpiece support provided by the relatively short length of the workpiece guide.

Another disadvantage of adjustable miter boxes is that the engagement between the notched semicircular angular adjustment flange and the fixed edge allows for lateral angular play of the saw guide, resulting in inaccurate cuts. Also, the saw blade clamping device does not accommodate the significantly thicker spine of conventional backsaws used in such miter boxes. This allows for additional unwanted play of the blade in the saw guide, further decreasing cutting accuracy.

Accordingly, a first object of the present invention is to provide a hand saw-type miter box which minimizes the play of the saw blade in the saw guide.

Another object of the present invention is to provide a hand saw-type miter box which secures the angular adjustment of the saw guide, thus promoting accurate cuts.

Still another object of the present invention is to provide an adjustable miter box which includes additional support formations for supporting the workpiece during cutting, yet is also short enough to fit in a conventional miter box case or tool box.

A further object of the present invention is to provide an adjustable miter box which is designed so that the saw may be operated from either side of the miter back.

SUMMARY OF THE INVENTION

Accordingly, the present invention provides an adjustable miter box featuring an offset saw guide which allows for significantly increased workpiece support. In addition, the present miter box has an angular adjustment mechanism which positively positions the blade angle. Another feature of the present invention is the saw blade clamping mechanism of the saw guide, which not only clamps the saw blade, but also grips the often thicker spine portion to better maintain accurate sliding action of the blade in the saw guide.

More specifically, the present invention includes an adjustable miter box for use with a miter saw having a blade, including a base having a top, a front face, a rear face, a first side and a second side, a generally vertically oriented pivot post located adjacent the rear face, and being disposed in an offset location closer to the first side than to the second side. The present invention also includes a saw guide including a vertical throughbore for matingly engaging the pivot post, and defining a slot for accommodating the blade of the miter saw. A significant advantage of the offset location of the pivot post is the allowance for a substantially longer miter back or fence to support the workpiece.

An angular locking device is positioned on the base for releasably fixing the angular position of the saw guide relative to the base. A workpiece support apparatus is provided and is secured to the base for securing a workpiece to be cut by the saw while the saw is slidably engaged in the slot.

In another embodiment, an adjustable miter box for use with a miter saw having a blade includes a base having a top, a front face, a rear face, a first side and a second side, and a generally vertically oriented pivot post located adjacent the rear face, the post being disposed in an offset location substantially closer to the first side than to the second side.

The miter box includes a saw guide having a front portion and a rear portion. The front portion is provided with a vertical throughbore for matingly engaging the pivot post, and having a curved protractor portion with a plurality of circumferentially spaced locator apertures, the front and rear portions defining a slot for slidably accommodating the blade of the miter saw. Angular locking pins are disposed on the base for releasably engaging the locator apertures for fixing the angular position of the saw guide relative to the base. A workpiece support apparatus is secured to the base for securing a workpiece for cutting by the saw while the saw is slidably engaged in the slot.

DETAILED DESCRIPTION OF THE PREFERRED EMBODIMENT

Figures 1, 2:
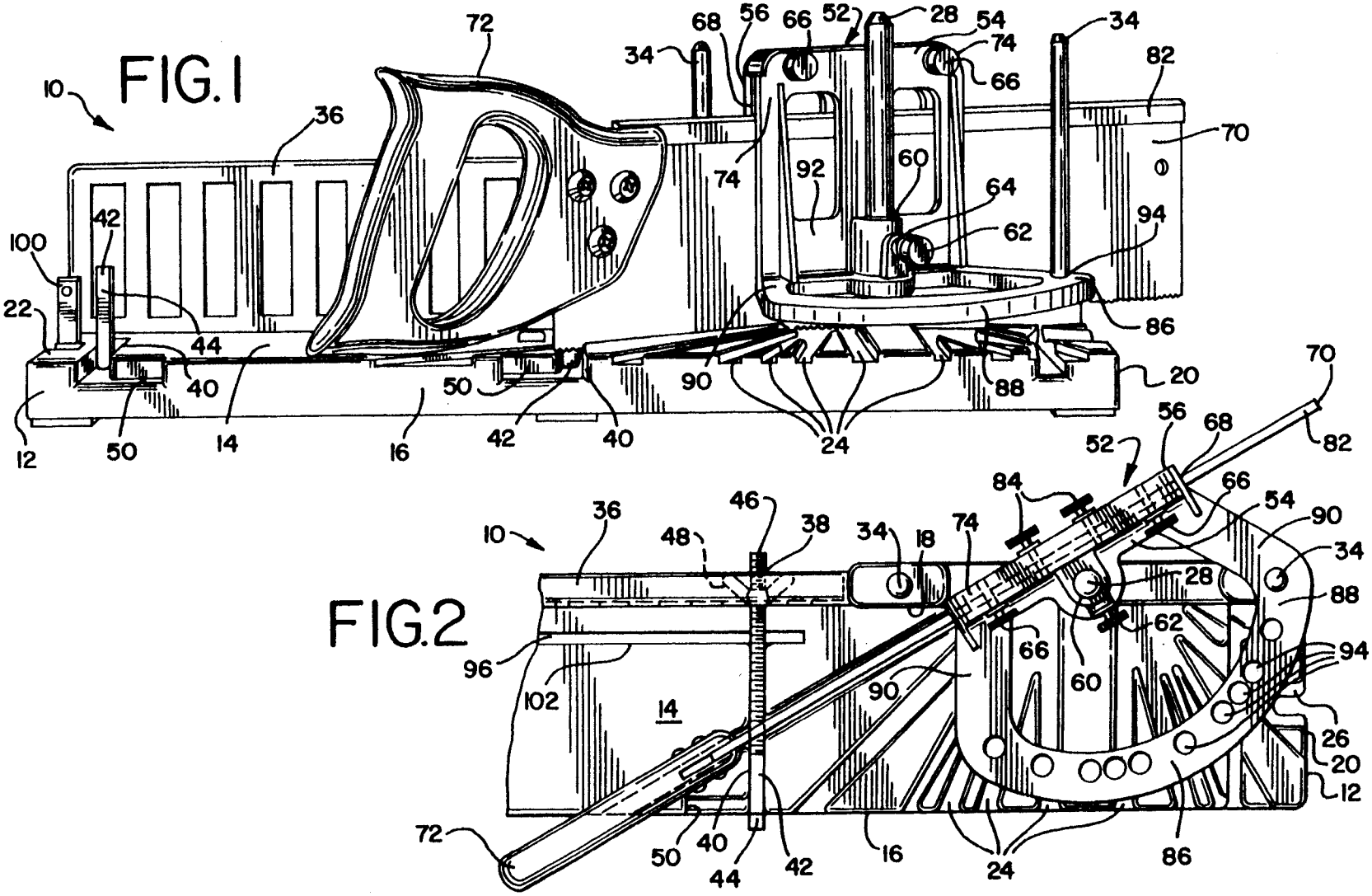
FIG. 1 is a front perspective elevational view of the miter box of the present invention.
FIG. 2 is an overhead plan view of the miter box shown in FIG. 1.

Referring now to the drawings, wherein like reference numerals designate like features, the miter box of the invention is generally designated 10, and includes a base 12 having a top 14, a front face 16, a rear face 18, a first side 20 and a second side 22. The base 12 is preferably cast or molded of a rigid, self-supporting and corrosion resistant material such as aluminum or plastic, and has a height of at least approximately 0.5 inches to maximize wear life. The top 14 includes a plurality angularly disposed, elongate, channel-shaped recess formations 24 for accommodating the cutting edge of a saw blade as it completely saws through a workpiece. A countersunk mounting groove 26 is preferably located in each of the first and second sides 20, 22 for mounting the base 12 to a workbench or table (not shown).

A generally vertically oriented pivot post 28 is located on the base 12 adjacent the rear face 18, and is located in an offset location closer to the first side 20 than to the second side 22. A major advantage of this location of the pivot post is that a significantly longer workpiece support area is provided, thus increasing the accuracy of cuts made with the present invention as opposed to conventional adjustable miter boxes. The pivot post 28 is secured in a vertically projecting boss formation 30 (Best seen in FIG. 4), which in the preferred embodiment is integrally formed with the base 12.

Also located on the base 12 are a pair of diametrically opposed locking pin bosses 32 which are located equidistant from the boss formation 30, and are also located adjacent the rear face 18. In the preferred embodiment, the locking pin bosses 32 are integrally formed with the base 12, and are each dimensioned with open upper recesses for securely accommodating an elongate, cylindrical locking pin 34. The locking pins 34, as well as the pivot post 28, may be secured in their respective bosses 32, 30 by threaded engagement, by adhesive or epoxy, or by welding. Upon their attachment to the bosses 32, the locking pins 34 are located on the right and left side of, and are coplanar with, the pivot post 28 adjacent the rear face 18 of the base 12.

A miter back or fence 36 is secured to the rear face 18 of the base 12 and is disposed thereon so that the linear axis of the fence 36 is coaxial with the line defined by the pivot post 28 and the locking pins 34. A pair of linearly spaced apertures 38 are formed in a lower portion of the fence 36 to be in register with a pair of transverse grooves 40 formed in the base 12. The grooves 40 are generally normal to the longitudinal axis of the base 12. An "L"-shaped workpiece clamp 42 having a short leg 44 and a relatively long, preferably threaded, leg 46 is disposed in each of the transverse grooves 40 so that the end of the long leg 46 is seated in the groove and passes through the aperture 38 to be engaged by a wingnut 48. If desired, the base 12 may also be provided with a short leg recess 50 for each of the short legs 44 of the clamps 42.

The present miter box 10 also includes a saw guide, generally designated 52, which maintains a selected angular orientation of the saw blade, and reduces the amount of play of the reciprocating blade compared to conventionally available adjustable miter boxes. The saw guide 52 basically includes a generally vertically projecting front portion 54 and a rear portion 56 which meet along a common edge 58 (Best seen in FIG. 4). In the preferred embodiment, the front and rear portions, 54, 56 are each die cast of aluminum or other suitable alloy, but may also be made of other suitable materials, including molded plastics.

A vertically opening throughbore 60 is located on the front portion 54 for matingly and pivotally engaging the pivot post 28. In order to adjust the vertical position of the saw guide 52 on the pivot post 28, a threaded fastener 62 such as a thumbscrew is engaged into a tapped opening 64 and is adapted for contacting the post 28. Depending on the tightness of the adjustment of the fastener 62, the saw guide 52 may still pivot about the post 28.

Figure 4:
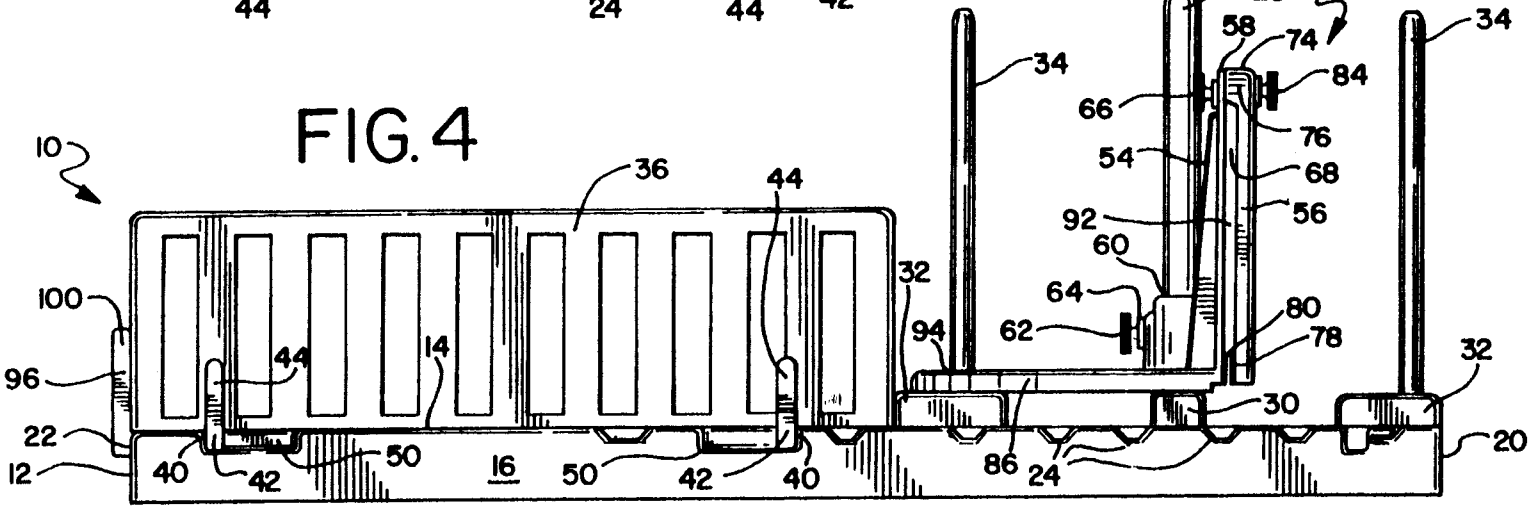
FIG. 4 is a front elevational view of the miter box depicted in FIG. 3.

Referring now to FIGS. 1 and 4, a pair of threaded fasteners 66 such as thumbscrews are also used to secure together the upper ends of the front and rear portions 54 and 56. When joined, the saw guide portions 54 and 56 define a slot 68 for accommodating the blade 70 of a miter saw 72. The fasteners 66 are preferably located in relatively widely spaced relationship, and are proximate the upper corners 74 of the front portion 54. The fasteners 66 engage a relatively thickened cross-sectional upper area 76 (Best seen in FIG. 4) of the rear portion 56. As the fasteners 66 are tightened, they increase the clamping force exerted by a rear portion blade guide 78 against a front portion blade guide 80.

Another adjustment of the present saw guide 52 relates to the fact that the spine 82 of most miter saws 72 is thicker in cross-section than the blade 70. To slidingly accommodate the spine 82 of the saw 70 while also exerting sufficient clamping force to securely hold the saw in the saw guide 52, a pair of saw spine clamping fasteners 84 are provided. The clamping fasteners 84 are preferably thumbscrews, and are threaded from the rear portion 56 into the front portion 54. In addition, the clamping fasteners 84 are located relatively closer together than the fasteners 66 (Best seen in FIGS. 2 and 3).

The present miter box 10 also features a mechanism for releasably and angularly locking the position of the saw guide 52 relative to the base 12 in a manner which is significantly more secure than conventional adjustable miter boxes. Specifically, this angular adjustment mechanism includes a protractor portion 86 which is secured to the front portion 54 of the saw guide 52. The protractor portion 86 is generally vertically flattened and includes an arcuate section 88 having a leg 90 at each end thereof. The legs 90 are secured to the front face 92 of the front saw guide portion 54.

In order to lock the saw guide 52 in position, the protractor portion 86 includes a plurality of spaced angle locator apertures 94 which correspond to angular positions of the saw guide relative to the base 12. Settings for 90°, 60°, 45°, 22½° and 15° are preferably included to provide a wide range of miter angle choices to the user. The apertures 94 are dimensioned to slidingly engage one of the locking pins 34. Once the protractor portion 86 of the saw guide 52 is locked upon the locking pin 34, the saw guide cannot deviate from its specified angular orientation. Consequently, more accurate cuts are obtainable from the present miter box. Also, depending on the application, the saw guide 52 can be rotated axially 180° about the pivot post 28 so that a selected one of the apertures 94 engages the other locking pin 34 to allow cutting from the rear of the base 12.

Figure 3:
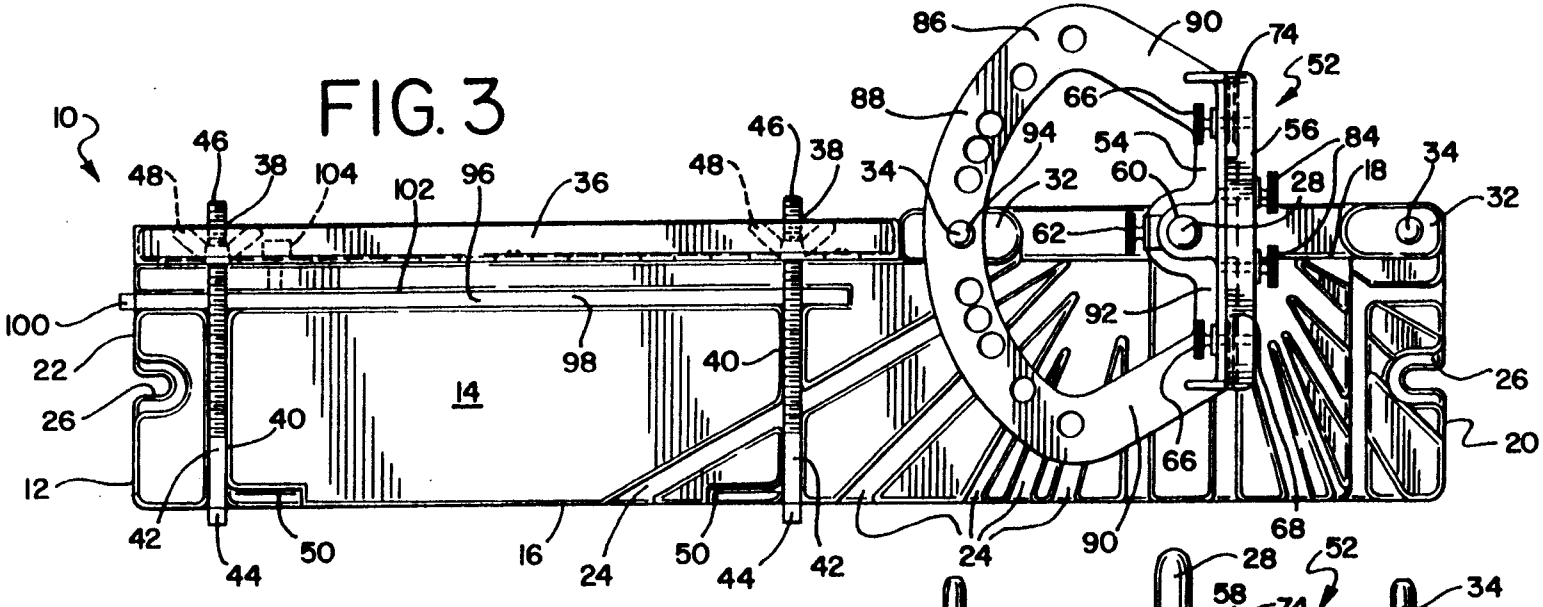
FIG. 3 is an overhead plan view of the miter box of the invention shown with the miter saw removed.

Referring now to FIGS. 3 and 4, if desired, the miter box 10 may be equipped with a retractable workpiece support 96 for providing additional support to pieces which extend beyond the second side 22 of the base 12. The workpiece support 96 is generally "L"-shaped, having a relatively long leg 98 and a relatively short leg 100. The long leg 98 is dimensioned to be slidably engaged in an elongate channel-shaped recess 102 in the base 12. Short leg 100 projects vertically above the base 12 to engage workpieces as they are being cut. The support 96 may be slidably drawn from the recess 102 to accommodate longer-length workpieces. It is contemplated that multiple workpieces may be stacked upon each other for simultaneous cutting, and be secured by the short leg 100. The position of the support 96 may be secured by a set screw 104 located on the rear face 18 of the base 12 (Best seen in FIG. 3).

In operation, the present miter box 10 is preferably secured to a substrate such as a workbench or table by passing bolts or screws through the mounting grooves 26 on the first and second sides of the base 12. Alternately, the base 12 may be secured in a vise. Next, the fasteners 66 and the clamping fasteners 84 are loosened, and the saw 72 is inserted into the saw guide 52. Appropriate adjustment is made of the fasteners 66 and the clamping fasteners 84 to permit smooth reciprocal sliding action of the saw without extraneous play or wobbling.

To set the saw guide 52 for the desired angular cut, the saw guide is lifted up and off of the pivot post 28, as well as the locking pins 34 and is thus disengaged from the base 12. Once the desired angular orientation is selected, the required position on the protractor portion 86 is located and is engaged upon one of the locking pins 34. The vertical position of the saw guide relative to the pivot post 28 is fixed by tightening the thumbscrew 62. The miter box 10 is now ready for receipt of the workpiece. Upon placement of the workpiece upon the base 12 and against the miter back 36, the workpiece is slid towards the saw guide to be in cutting proximity of the blade as is known in the art. The wingnuts 48 are loosened so that the workpiece clamps 42 may be slid in the transverse grooves 40 until the short legs 44 engage the workpiece. Once the workpiece is properly positioned, the wingnuts 48 are tightened to secure the workpiece to the fence. If desired, the supplemental support 96 may be extended and secured by tightening of the thumbscrew 104.

Thus, the present miter box features a more secure saw blade mounting mechanism, as well as a more positive workpiece mounting arrangement than available in conventional adjustable miter boxes. Saw blade mounting is achieved by the pivotable saw guide, and the offset location of the saw guide allows for a relatively longer miter back for additional workpiece support, while not lengthening the base. Thus, the present miter box fits into the same cases or tool boxes as do conventional adjustable miter boxes.

While a particular embodiment of the adjustable miter box with offset cutting location of the invention has been shown and described, it will be appreciated by those skilled in the art that changes and modifications may be made thereto without departing from the invention in its broader aspects and as set forth in the following claims.

What is claimed is:

1. An adjustable miter box for use with a miter saw having a blade, comprising:

a base having a top, a front face, a rear face, a first side and a second side;

a generally vertically oriented pivot post located adjacent said rear face, and being disposed in an offset location closer to said first side than to said second side;

a saw guide including a vertical throughbore for matingly engaging said pivot post, and defining a slot for accommodating the blade of the miter saw, said saw guide including a protractor portion having a plurality of peripherally spaced angle locator apertures;

angular locking means on said base for releasably fixing the angular position of said saw guide relative to said base, said angular locking means including at least one fixed locking pin located on said base for engaging and passing through a selected one of said angle locator apertures, said pivot post and said at least one locking pin extending vertically from said base, and said saw guide is slidably engageable on said pivot post and said at least one locking pin to be angularly adjustable relative to said base; and workpiece support means secured to said base for securing a workpiece to be cut by the saw while the saw is slidably engaged in said slot.

2. The miter box as defined in claim 1 wherein said at least one locking pin is coplanar with said pivot post.

3. The miter box as defined in claim 1 wherein said saw guide includes blade thickness adjustment means for slidably securing the blade of the saw to said base.

4. The miter box as defined in claim 3 wherein said saw guide includes a front portion and a rear portion, said blade thickness adjustment means including threaded adjusting screws located on both of said front and said rear portions to adjust clamping force exerted by said rear portion against a rear side of said front portion, and also to clampingly engage a spine portion of the saw blade.

5. The miter box as defined in claim 1 wherein said workpiece support means includes a miter back located adjacent said rear face of said base and being substantially coplanar with said pivot post.

6. The miter box as defined in claim 5 wherein said workpiece support means further includes a retractable workpiece support member slidably located in an elongate recess in said base for selective extension past said second side of said base.

7. The miter box as defined in claim 5 wherein said workpiece support means further includes at least one adjustable workpiece clamp located in said base and disposed generally normally to said miter back.

8. The miter box as defined in claim 7 wherein said at least one workpiece clamp includes a threaded "L"-shaped rod having a short leg portion for engaging the workpiece.

9. The miter box as defined in claim 1 further including means for adjusting and releasably locking the height at which said saw guide is disposed on said pivot post.

10. The miter box as defined in claim 1 wherein said angular locking means includes a first of said angular locking pins disposed on said base at said first side for releasably engaging a corresponding one of said locator apertures for fixing the angular position of said saw guide relative to said base for access from said front face, and a second locking pin being located on said base closer to said second side then said first pin for adjustably fixing the angular position of said saw guide for access from said rear face of said base, and said locator apertures being selectively engageable with at least one of said locking pins for positioning said saw guide relative to said base so that the saw blade may be inserted into said saw guide for cutting workpieces from either said front face or said rear face of said base.

11. An adjustable miter box for use with a miter saw having a blade, comprising:

a base having a top, a front face, a rear face, a first side and a second side;

a generally vertically oriented pivot post located adjacent said rear face, and being disposed in an offset location substantially closer to said first side than to said second side;

a saw guide including a front portion and a rear portion, said front portion provided with a vertical throughbore for matingly engaging said pivot post, and having a curved protractor portion with a plurality of circumferentially spaced locator apertures, said front and rear portions defining a slot for slidably accommodating the blade of the miter saw;

a first angular locking pin disposed on said base at said first side for releasably engaging a corresponding selected one of said locator apertures for adjustably fixing the angular position of said saw guide relative to said base for access from said front face, and a second locking pin being located on said base closer to said second side than said first pin for releasably engaging a selected one of said locator apertures for adjustably fixing the angular position of said saw guide for access from said rear face of said base, and said locator apertures being selectively engageable with at least one of said locking pins for positioning said saw guide relative to said base so that the saw blade may be inserted into said saw guide for cutting workpieces from either said front face or said rear face of said base; and workpiece support means secured to said base for securing a workpiece for cutting by the saw while the saw is slidably engaged in said slot.

12. The miter box as defined in claim 11 wherein said saw guide includes saw blade clamping means for securing the blade of the saw relative to said guide, said clamping means including threaded clamping fasteners located on both said front portion and said rear portion of said saw guide.

13. The miter box as defined in claim 11 wherein said locking pins and said pivot post are substantially coplanar.

14. The miter box as defined in claim 13 wherein said workpiece support means includes a miter back located adjacent said rear side of said base and being substantially coplanar with said pivot post and said first and second locking pins.

15. The miter box as defined in claim 11 wherein said workpiece support means includes a retractable workpiece support member slidably located in an elongate recess in said base for selective extension past said second side of said base.

16. The miter box as defined in claim 11 wherein said workpiece support means further includes at least one adjustable workpiece clamp located in said base and disposed generally normally to said miter back.

17. The miter box as defined in claim 16 wherein said at least one workpiece clamp includes a threaded "L"-shaped rod having a short leg portion for engaging the workpiece.

* * * * *